United States Patent [19]

Azovtsev et al.

[11] 4,238,037

[45] Dec. 9, 1980

[54] ANGLE-OF-HEEL CONTROL MEANS FOR A FLOATING CRANE

[76] Inventors: Alexandr A. Azovtsev, ulitsa Marshala Govorova, 14, kv. 130, Leningrad; Nikolai D. Velikoselsky, prospekt Gagarina, 15, kv. 29, Sevastopol; Sergei S. Vinogradov, prospekt Kutuzovsky, 26, kv. 246; Alexei E. Vorontsov, naberezhnaya T. Shevchenko, 1/2, kv. 88, both of Moscow; Lev E. Kuznetsov, ulitsa Demyana Bednogo, 30, kv. 29, Leningrad; Viktor I. Podbeltsev, ulitsa B. Morskaya, 38, kv. 4, Sevastopol; Mikhail E. Polevikov, prospekt Zanavsky, 28, kv. 153; Georgy M. Sviridov, prospekt Kosmonavtov, 30, korpus 2, kv. 91, both of Leningrad; Valery G. Fadeev, ulitsa Primorskaya, 27, kv. 45; Anatoly A. Cherevaty, ulitsa Nadezhdintsev, 20, kv. 32, both of Sevastopol, all of U.S.S.R.

[21] Appl. No.: 967,984

[22] Filed: Dec. 11, 1978

[30] Foreign Application Priority Data

Dec. 15, 1977 [SU] U.S.S.R. ..... 2550651[I]

[51] Int. Cl.[3] ..... B66C 23/52; B66C 13/48

[52] U.S. Cl. ..... 212/149; 114/61; 212/191; 340/685

[58] Field of Search ..... 212/3, 39 R, 39 MS, 212/39 A; 340/506–507, 517, 685; 114/61, 258, 261, 264

[56] References Cited

U.S. PATENT DOCUMENTS

| | | | |
|---|---|---|---|
| 2,346,066 | 4/1944 | Conrad | 212/39 MS |
| 3,269,344 | 8/1966 | Bell | 114/125 |
| 3,631,537 | 12/1971 | Zibolski | 340/685 |
| 4,037,742 | 7/1977 | Gustafsson | 212/39 MS |
| 4,047,617 | 9/1977 | Tax et al. | 212/39 MS |
| 4,078,668 | 3/1978 | Hohmann | 212/39 MS |
| 4,150,635 | 4/1979 | Lloyd et al. | 114/61 |

FOREIGN PATENT DOCUMENTS 2706885 1/1977 Fed. Rep. of Germany .

*Primary Examiner*—Stephen G. Kunin
*Assistant Examiner*—R. B. Johnson
*Attorney, Agent, or Firm*—Fleit & Jacobson

[57] ABSTRACT

A floating crane on a pontoon of which installed are a crane slewing portion which carries a boom and boom slewing, boom luffing and load hoisting drives controlled by respective master controllers, and also a heel compensation device controlled by a signal from an angle-of-heel transmitter. The crane comprises a control system which controls operation of said drives by a signal from the angle-of-heel transmitter and includes a device which converts the value of a heeling angle to an electrical signal, the input of this device being connected to the angle-of-heel transmitter and the output, to one input of an angle-of-heel comparator unit, another input of this comparator unit being connected to a signal setting device generating a signal proportional to an allowable angle of heel, and the output of the comparator unit is connected in parallel to one group of inputs of OR logic units, the other inputs thereof being connected to the outputs of master controllers of respective drives, the outputs of the OR logic are connected to the inputs of respective drives via voltage converters.

1 Claim, 4 Drawing Figures

ANGLE-OF-HEEL CONTROL MEANS FOR A FLOATING CRANE

The present invention relates to handling equipment and more particularly to floating cranes.

Known in the art are cranes whose floating base, i.e. a pontoon, mounts a crane slewing portion, i.e. a framework adapted to rotate relative to a slewing ring secured on the pontoon.

Installed on this framework is a boom with boom luffing, boom slewing and load hoisting drives controlled by respective master controllers. The pontoon accommodates a heel compensation means, comprising a counterweight arranged on a trolley installed on rails laid on the pontoon.

In the cranes heretofore described, the master controllers of the boom slewing, boom luffing and load hoisting drives are switched on and off manually by the crane operator according to visually observed readings of the angle-of-heel transmitter. Such a control of said drives requires constant attention on the part of the crane operator which reduces the operating reliability of the crane.

It is an object of the present invention to provide a floating crane in which the boom slewing, boom luffing and load hoisting drives are controlled automtaically according to a heel of the floating crane.

In accordance with this and other objects of the invention, there is provided a floating crane on a pontoon of which installed are a crane slewing portion which carries a boom and boom slewing, boom luffing and load hoisting drives controlled by respective master controllers and also a heel compensation means controlled by a signal from an angle-of-heel transmitter, according to the invention, the crane comprises a control system which controls operation of the boom slewing, boom luffing and load hoisting drives by a signal from the angle-of-heel transmitter and includes a device which converts the value of a heeling angle to an electrical signal, an input of this device being connected to the angle-of-heel transmitter and an output, to one input of an angle-of-heel comparator unit, another input of this comparator unit being connected to a signal setting device generating a signal proportional to an allowable angle of heel, and an output of the comparator unit is connected in parallel to one group of inputs of OR logic units, other inputs thereof being connected to outputs of master controllers of respective drives, outputs of the OR logic units are connected via voltage converters to the inputs of the respective drives.

In a floating crane of the invention the control of the boom slewing, boom luffing and load hoisting drives is fully automated and synchronized with the control of the heel compensation means according to a heel of the floating crane.

The invention will now be described with reference to a specific embodiment thereof taken in conjunction with the accompanying drawings, in which.

Figure 2:
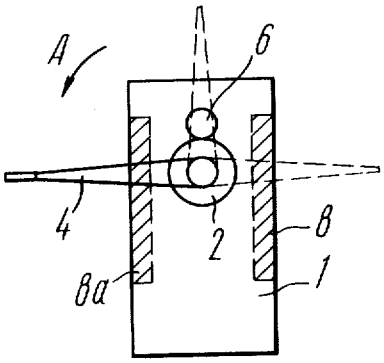
FIG. 2 is a top view thereof.
Figure 1:
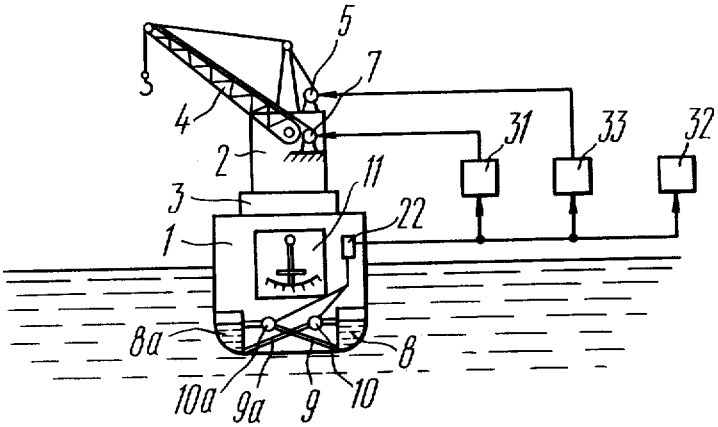
FIG. 1 is a schematic cross-sectional view of a floating crane.
Figure 3:
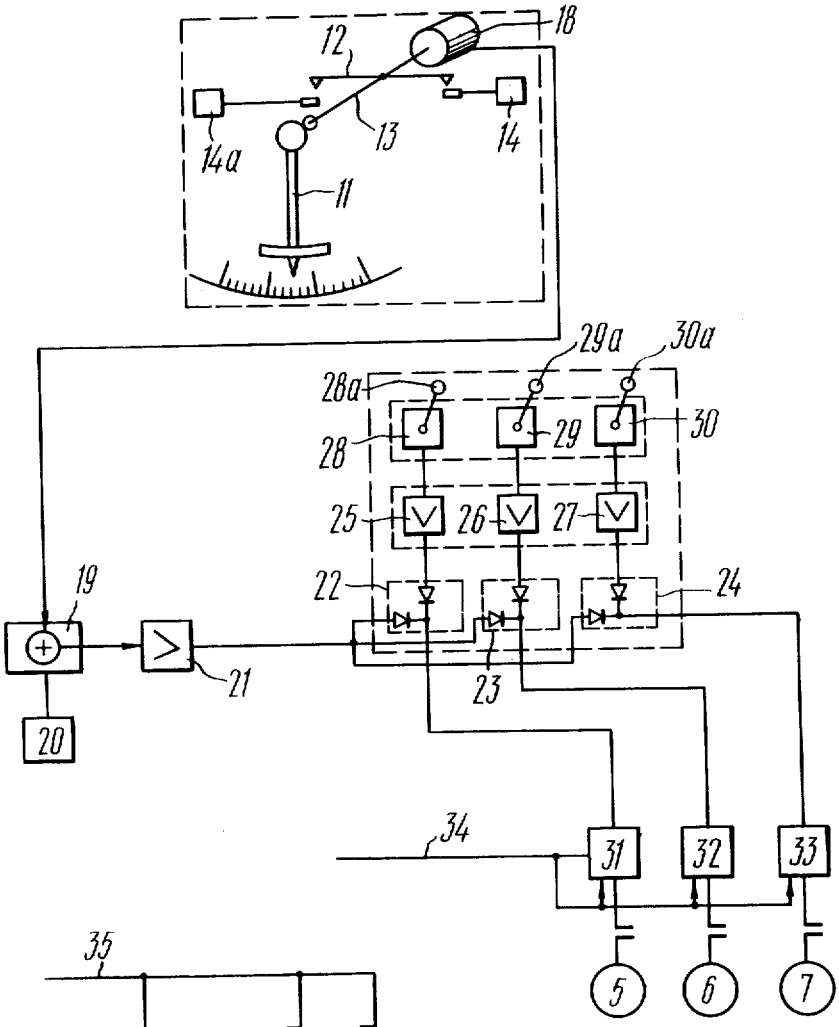
FIG. 3 represents an electric control circuit of boom slewing, boom luffing and load hoisting drives.

A floating crane has a pontoon 1 (FIG. 1) which accommodates a crane comprising a slewing portion, i.e. a framework 2 installed on a slewing ring 3 secured on the pontoon 1. Mounted on the framework is a boom 4 with drives 5, 6 (FIG. 2) and 7 (FIG. 1) which respectively accomplish luffing of the boom 4, slewing of the boom 4 and hoisting of a load. The pontoon 1 accommodates a heel compensation means, comprising two tanks 8 and 8a disposed respectively at the starboard and portside of the pontoon 1 and interconnected with each other by pipelines 9 and 9*a* through pumps 10 and 10*a* controlled by a signal from an angle-of-heel transmitter 11 of the pontoon 1. A control circuit of the pumps 10 and 10*a* comprises a lever 12 (FIG. 3) secured on a shaft 13 coupled with the angle-of-heel transmitter 11. When the angle-of-heel transmitter 11 deflects, the lever 12 energizes a starboard heel relay 14 or a portside heel relay 14*a*. These relays 14 and 14*a* convert the value of a heeling angle to an electrical signal.

It is to be understood that the relays 14 and 14*a* may be of any known design suitable for the purpose.

The relay 14 (14*a*) closing a contact 15 (15*a*) energizes a contactor 16 (16*a*) whose contact 17 (17*a*) switches on the pump 10 (10*a*).

A control system of drives 5, 6, 7 which respectively accomplish luffing of the boom 4, slewing of the boom 4 and hoisting of a load, comprises a device 18 which converts the value of a heeling angle to an electrical signal for which purpose this device is coupled to the angle-to-heel transmitter through the shaft 13. It is obvious that the device may be of any known design suitable for the purpose. An output of the device 18 is connected to one input of an angle-to-heel comparator unit 19 to another input of which is connected a signal setting device 20 generating a signal proportional to an allowable angle of heel. An output of the comparator unit 19 is connected to an input of an amplifier 21. An output of the amplifier 21 is connected in parallel to one group of inputs of OR logic units 22, 23, 24, other inputs thereof being connected via amplifiers 25, 26, 27 to outputs of master controllers 28, 29, 30 of the respective drives 5, 6, 7 accomplishing luffing of the boom 4, slewing of the boom 4 and hoisting of a load. The master controllers 28, 29, 30 are provided with handles 28*a*, 29*a*, 30*a*, respectively. Outputs of the OR logic units 22, 23, 24 are connected via voltage converters 31, 32, 33 to the inputs of the respective drives 6, 5, 7 accomplishing slewing of the boom 4, luffing of the boom 4 and hoisting of a load.

It will be apparent that the comparator unit 19, the signal setting device 20, the amplifier 21 and the OR logic units 22, 23, 24 may have a circuit of any known design suitable for the purpose.

Figure 4:
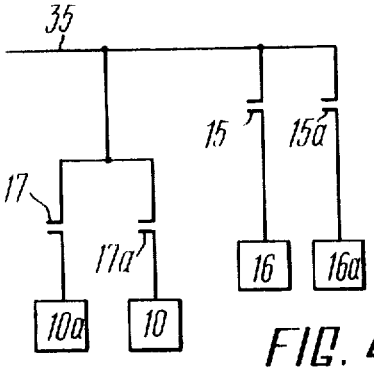
FIG. 4 is a connection diagram of a heel compensation means.

Reference numerals 34 and 35 (FIG. 4) are used to represent a floating crane power mains supplying the drives 5, 6, 7 and the drives of the pumps 10 and 10*a*.

The floating crane operates in the following way. Before hoisting a load of the limiting weight, the stabilizing tanks 8 and 8*a* of the starboard and portside respectively should be half filled with water. The rigged load hoisted in the centerline plane should be slewed, e.g. to the left as is shown by an arrow "A" on FIG. 2. In this case the crane operator having set the handle 29*a* of the master controller 29 to the neutral position, i.e. zero state of the master controller, have prepared the control circuit of the drive 6 of the boom 4 slewing for operation.

To carry the load to any side from the centerline plane of the floating crane, the crane operator by tilting the handle 29*a* of the master controller 29 to the appropriate side transmits a signal via the amplifier 26 to the OR logic unit 23. At the same time, the OR logic unit 23 receives a maximum intensity signal transmitted from the angle-of-heel comparator unit 19 via the amplifier 21, as at the initial moment when the boom 4 starts slewing away from the centerline plane, the difference of signals coming from the signal setting device 20 and the device 18 producing the running value of the heeling angle is at a maximum.

Inasmuch as the OR logic unit 23 is built on the principle of selecting a minimum intensity signal on its inputs, a minimum intensity signal is passed from the master controller 29 to the input of the voltage converter 32. As the slewing motion of the boom 4 proceeds, a heel sets up, for example, to the portside. The angle-of-heel transmitter 11 generates two signals. One of these signals via the relay 14*a* switches on the drive of the pump 10 which starts to transfer the water ballast from the portside stabilizing tank 8*a* to the starboard stabilizing tank 8.

As the capacity of the pump 10 is limited, the portside stabilizing tank 8*a* and the starboard stabilizing tank 8 are unable to compensate for the heel set up to the portside, in time. Therefore, the difference of the signals coming from the signal setting device 20 and device 18 decreases. This difference of the signals which is decreasing with an increase of the heeling angle passes from the comparator unit 19 to the input of the OR logic unit 23 in which a minimum intensity signal is selected from two possible signals, i.e. one given by the master controller 29 and the other given by the heel measuring unit (the electrical signal from the comparator unit 19 passes via the amplifier 21). The minimum intensity signal of the two possible signals passes to the input of the voltage converter 32 of the slewing drive 6 of the boom 4, thereby limiting the speed of slewing down to a complete stop when the heel reaches the maximum preset value, as in this case the signal from the angle-of-heel comparator unit 19 will be equal to zero.

As the pump 10 operates, the heel reduces, the signal from the comparator unit 19 increases, i.e. becomes distinct from zero, and the slewing drive 6 of the boom 4 is allowed to continue operation, thus turning the boom 4 in the required direction. The drives 5, 7 accomplishing luffing of the boom 4 and load hoisting operate in a similar manner.

The proposed invention makes it possible to increase the boom outreach with a load over the floating crane side to a maximum and to carry out all required handling operations with the angle of heel maintained within the allowable limits without increasing the displacement of the floating crane, its draft and overall dimensions of the pontoon.

What is claimed is:

1. A floating crane, comprising: a pontoon, a crane slewing portion installed on said pontoon; a boom mounted on said crane slewing portion so that it may be slewed and luffed; a slewing drive of said boom, mounted on said crane slewing portion; a luffing drive of said boom, mounted on said crane slewing portion; a load hoisting drive mounted on said crane slewing portion; a heel compensation means; an angle-of-heel transmitter; said heel compensation means controlled by a signal from said angle-of-heel transmitter; a control system which controls operation of said drives of said boom slewing, said boom luffing and load hoisting by a signal from said angle-of-heel transmitter, including: a device connected by its input to said angleof-heel transmitter and converting the value of a heeling angle to an electrical signal, an angle-of-heel comparator unit, an output of said device being connected to one input of said comparator unit, a signal setting device generating a signal proportional to an allowable angle of heel and connected to another input of said comparator unit, OR logic units, an output of said comparator unit connected in parallel to one group of inputs of said OR logic units, master controllers of respective said drives of said boom slewing, said boom luffing and load hoisting, other inputs of said OR logic units being connected to outputs of said master controllers, voltage converters, outputs of said OR logic units connected to inputs of said voltage converters, outputs of said voltage converters connected to inputs of said drives of said boom slewing, said boom luffing and load hoisting, as a result of which the control of said drives is fully automated and synchronized with the control of the heel compensation means according to a heeling angle of the floating crane.

* * * * *